US010180137B2

(12) United States Patent
Waterbury

(10) Patent No.: US 10,180,137 B2
(45) Date of Patent: Jan. 15, 2019

(54) REMANUFACTURING A TRANSMISSION PUMP ASSEMBLY

(71) Applicant: FORD GLOBAL TECHNOLOGIES, LLC, Dearborn, MI (US)

(72) Inventor: Edwin J. Waterbury, Livonia, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 538 days.

(21) Appl. No.: 14/933,027

(22) Filed: Nov. 5, 2015

(65) Prior Publication Data

US 2017/0130714 A1 May 11, 2017

(51) Int. Cl.

| | |
|---|---|
| ***F04C 2/08*** | (2006.01) |
| ***F04C 2/10*** | (2006.01) |
| ***F01C 21/10*** | (2006.01) |

(52) U.S. Cl.

CPC ..... *F04C 2/102* (2013.01); *F01C 21/108* (2013.01); *F04C 2/084* (2013.01); *F04C 2/086* (2013.01); *F04C 2230/80* (2013.01); *F04C 2230/85* (2013.01); *F04C 2240/20* (2013.01); *F04C 2240/30* (2013.01)

(58) Field of Classification Search

CPC ..... F04C 2230/80; F04C 2230/85; Y10T 29/49236; Y10T 29/49238; Y10T 29/49726

See application file for complete search history.

(56) References Cited

U.S. PATENT DOCUMENTS

| | | | | |
|---|---|---|---|---|
| 3,365,783 | A * | 1/1968 | Foster | F16H 57/023 29/402.08 |
| 4,859,160 | A | 8/1989 | White, Jr. | |
| 6,584,686 | B1 * | 7/2003 | Clark | B23P 6/00 29/401.1 |
| 6,675,453 | B2 * | 1/2004 | Briggs | F16H 57/021 29/401.1 |
| 7,384,251 | B2 | 6/2008 | Fujiki et al. | |
| 7,481,633 | B2 | 1/2009 | White, Jr. | |
| 8,632,323 | B2 | 1/2014 | Uozumi et al. | |
| 8,801,411 | B2 | 8/2014 | Mori | |

* cited by examiner

*Primary Examiner* — Jason L Vaughan
*Assistant Examiner* — Amanda J Meneghini
(74) *Attorney, Agent, or Firm* — James Dottavio; MacMillan, Sobanski & Todd, LLC

(57) ABSTRACT

A transmission pump is be removed from service and remanufactured into a remanufactured transmission pump. A first gear assembly is removed from the pump. A bore of the pump is machined from a first depth to a greater second depth. A second gear assembly is installed in the machined bore. The second gear assembly has a same horizontal geometry and a greater axial depth than the first gear assembly.

14 Claims, 7 Drawing Sheets

REMANUFACTURING A TRANSMISSION PUMP ASSEMBLY

BACKGROUND OF INVENTION

The present invention relates to automotive transmissions and in particular to remanufacturing of a transmission pump for use in a remanufactured automotive transmission.

The automotive transmission may experience a failure and, subsequently, be removed from service, remanufactured, and returned to service. Any abnormally worn parts are repaired or replaced during remanufacturing. For example, if the pump pocket bore is worn, the bore may be machined to a larger diameter and a correspondingly larger diameter set of pump gears installed.

Also during remanufacturing of the transmission, flow rate through the pump may be increased. The pump may be remanufactured to increase an amount of transmission fluid that is pumped for every revolution of the pump. For example, the larger diameter set of pump gears may have pump chambers with larger radial areas. Alternatively, an unchanged diameter set of pump gears having larger radial area pump chambers may be used. Alternatively, a larger diameter set of pump gears having unchanged radial areas of the pump chambers may be used. Alternatively, a set of pump gears having the same diameter but larger radial areas may be used with the same diameter but with larger radial areas of the pump chambers or larger diameter pump gears may be used without changing the radial areas of the pump chambers. However, it is desirable for flow characteristics at the inlet and outlet ports to be maintained when the flow rate is increased. Original gears kept because the pump bore is not worn maintains flow characteristics, but does not increase flow rate. Using the larger diameter gears with larger radial areas increases flow rate, but may not maintain flow characteristics. Furthermore, the larger diameter gears have a greater circumferential area which reduces efficiency of the pump.

SUMMARY OF INVENTION

An embodiment contemplates a method of remanufacturing a pump for an automotive transmission. A first gear assembly is removed from a bore of the pump. The bore is machined from a first depth to a greater second depth. A second gear assembly is installed in the machined bore. The second gear assembly has a same horizontal geometry and a greater axial depth than the first gear assembly.

Another embodiment contemplates a method for remanufacturing a pump of an automotive transmission. To access the pump, a removed from service transmission is disassembled. Inner and outer gears are removed from a bore of the pump. The bore is machined from a first depth to a greater second depth. New inner and outer gears are installed in the machined bore. The new inner and outer gears have a same horizontal geometry and a greater axial depth than the removed inner and outer gears. The horizontal geometry is dimensions, perpendicular to the axial depth, between the removed inner and outer gears and between the new inner and outer gears. The transmission is reassembled after the new inner and outer gears are installed.

Another embodiment contemplates a remanufactured pump for an automotive transmission. The pump comprises a pump body, a remanufactured bore in the pump body, a new gear assembly installed in the bore, an inlet port in the pump body, and an outlet port in the pump body. The remanufactured bore has a greater second depth than an originally manufactured first depth. The new gear assembly has a same horizontal geometry and a greater axial depth than an original gear assembly. The horizontal geometry is dimensions, perpendicular to the axial depth, between first inner and outer gears of the original gear assembly and between second inner and outer gears of the new gear assembly. The inlet and outlet ports are unchanged when the pump is remanufactured.

An advantage of an embodiment is increasing transmission pump flow rate while maintaining flow characteristics at inlet and outlet ports to the pump.

DETAILED DESCRIPTION

Figure 1:
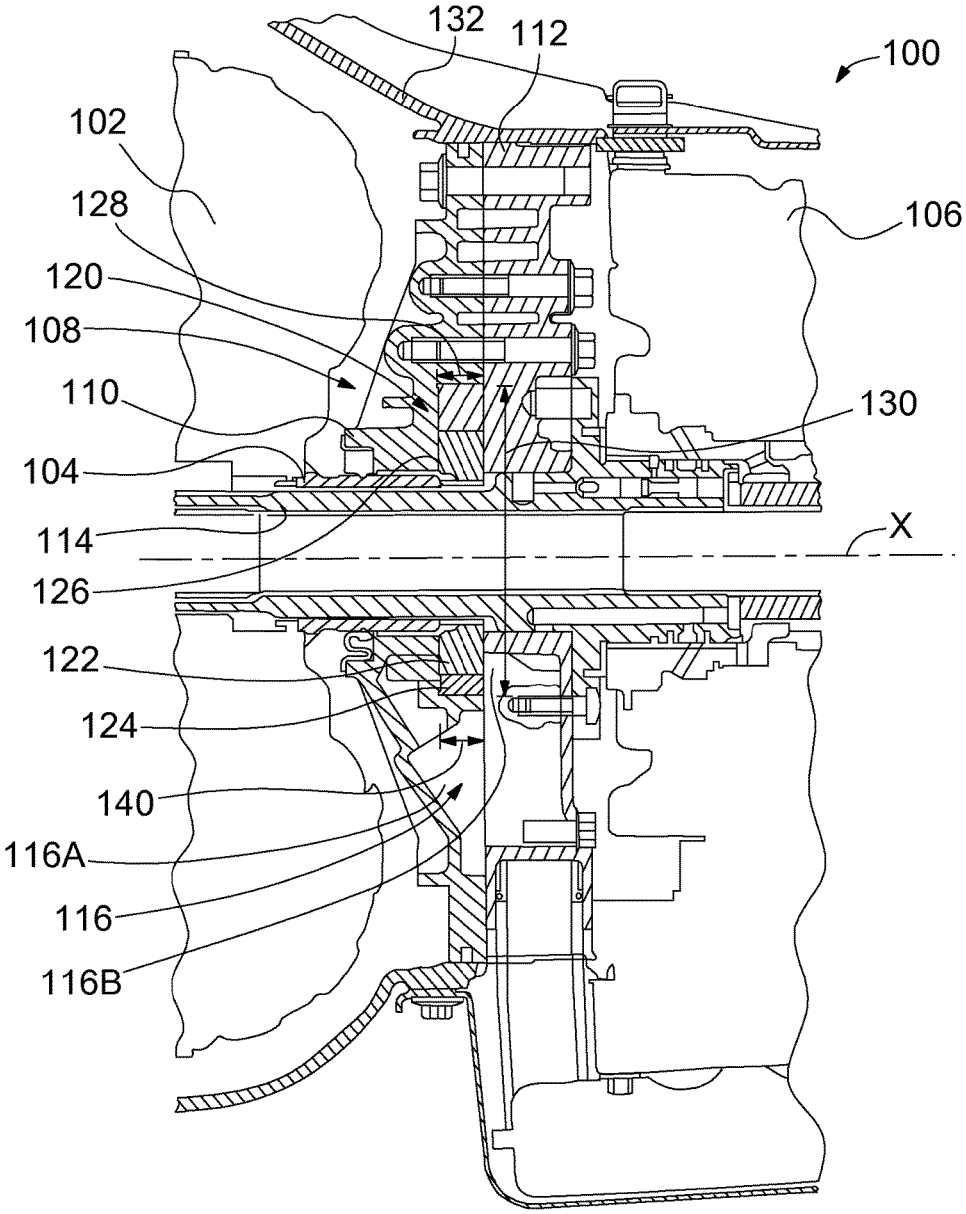
FIG. 1 is a section view of a portion of an automotive transmission including a transmission pump.
Figure 2:
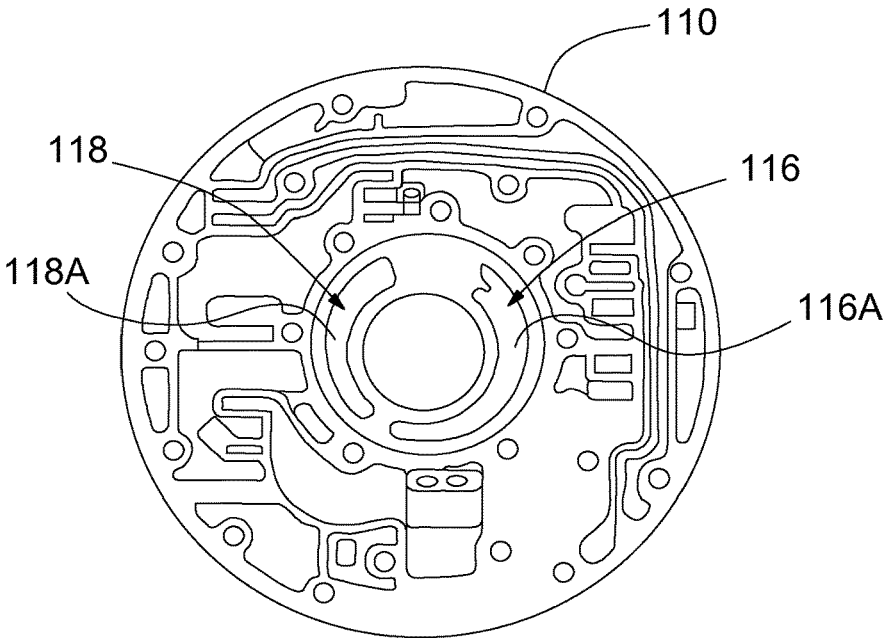
FIG. 2 is an elevation view of a portion of the transmission pump illustrated in FIG. 1.
Figure 3:
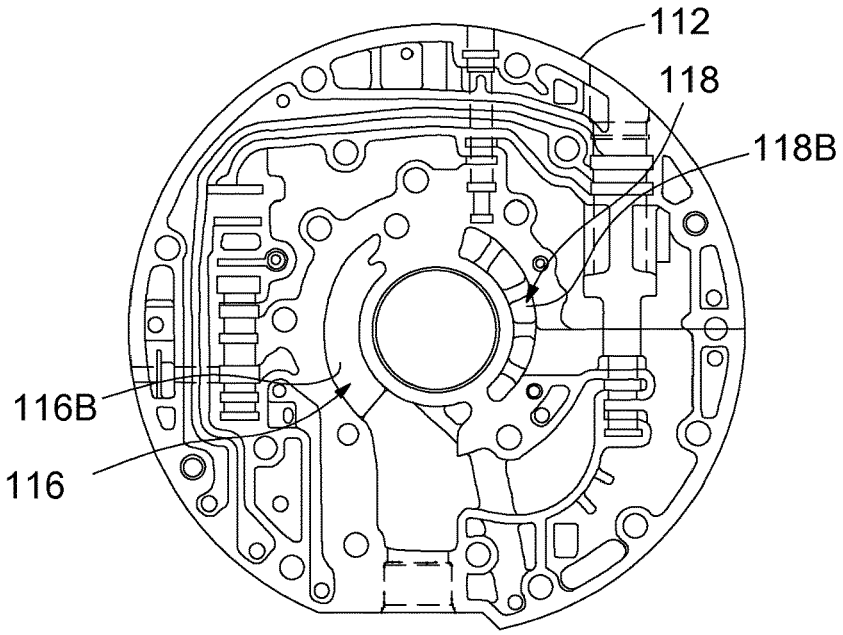
FIG. 3 is an elevation view of a portion of the transmission pump illustrated in FIG. 1.

FIGS. 1-3 illustrate a portion of an automotive transmission, indicated generally at 100. The transmission 100 is merely exemplary and may take other forms.

The transmission 100 includes a torque converter 102 supported on a torque converter hub 104 and planetary gears 106, all of which are conventional and known to those skilled in the art. The torque converter supplies torque to a transmission pump assembly, indicated generally at 108. The pump assembly includes a pump body first part 110 which supports the torque converter hub 104, a pump body second part or control body 112 which supports a stator support assembly 114, an inlet port indicated generally at 116 and comprising first and second inlet portions 116A and 1168, respectively, and an outlet port, indicated generally at 118, and comprising first and second outlet portions 118A and 1188, respectively (illustrated in FIGS. 2 and 3). The first inlet portion 116A and first outlet portion 118A are in the pump body first part 110 and the second inlet portion 1168 and the second outlet portion 1188 are in the pump body second part 112. The pump body first and second parts 110 and 112, respectively, are joined together to house a gear assembly, indicated generally at 120. The gear assembly 120 has an inner gear 122 and an outer gear 124, both of which are housed by a pump pocket bore 126 having a first bore depth 128 and a first bore diameter 130. Torque is supplied to the gear assembly 120 via the torque converter hub 104.

The transmission 100 is housed by a housing 132. The transmission 100 has a central axis X.

Figure 4:
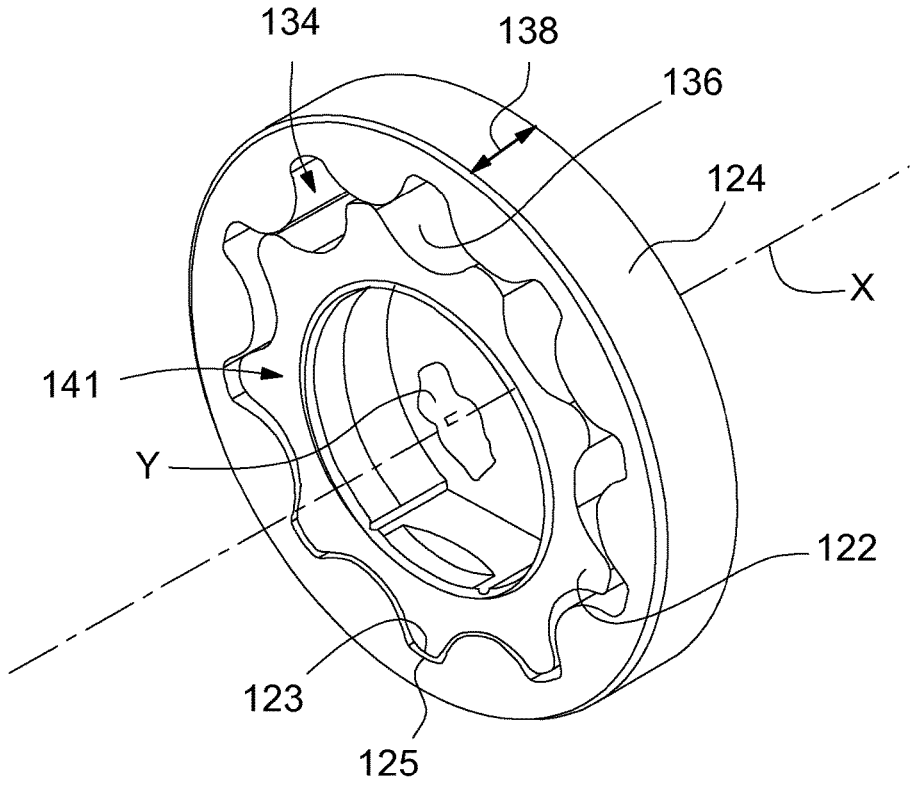
FIG. 4 is a perspective view of gears for the transmission pump illustrated in FIG. 1.
Figure 5:
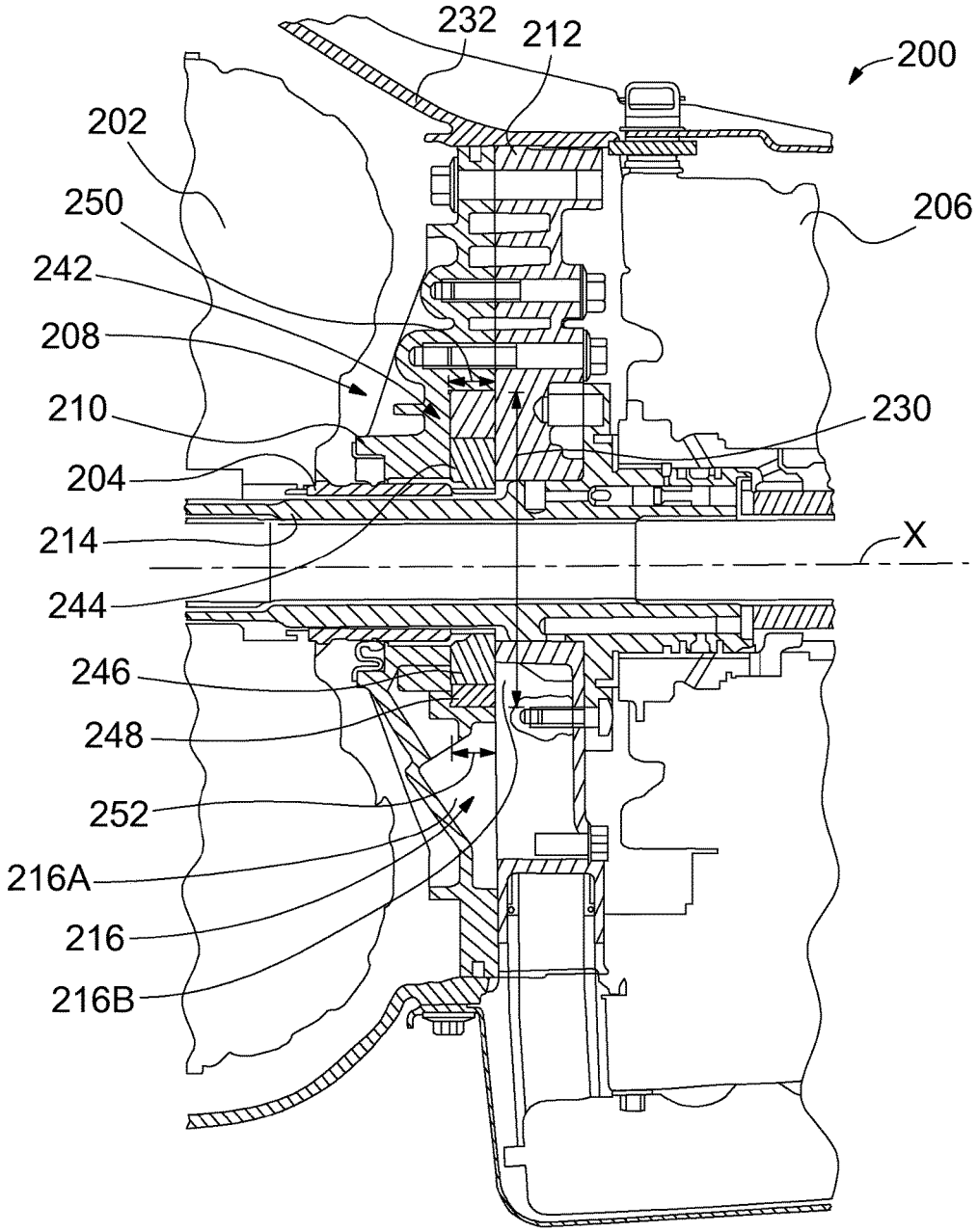
FIG. 5 is a section view of a portion of a remanufactured automotive transmission including a remanufactured transmission pump.
Figure 6:
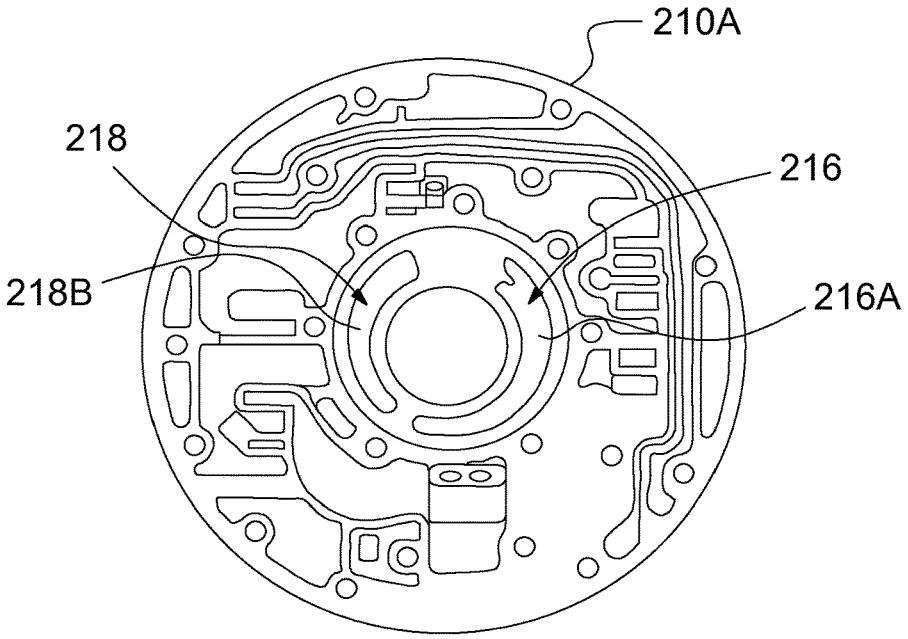
FIG. 6 is an elevation view of a portion of the remanufactured transmission pump illustrated in FIG. 5.
Figure 7:
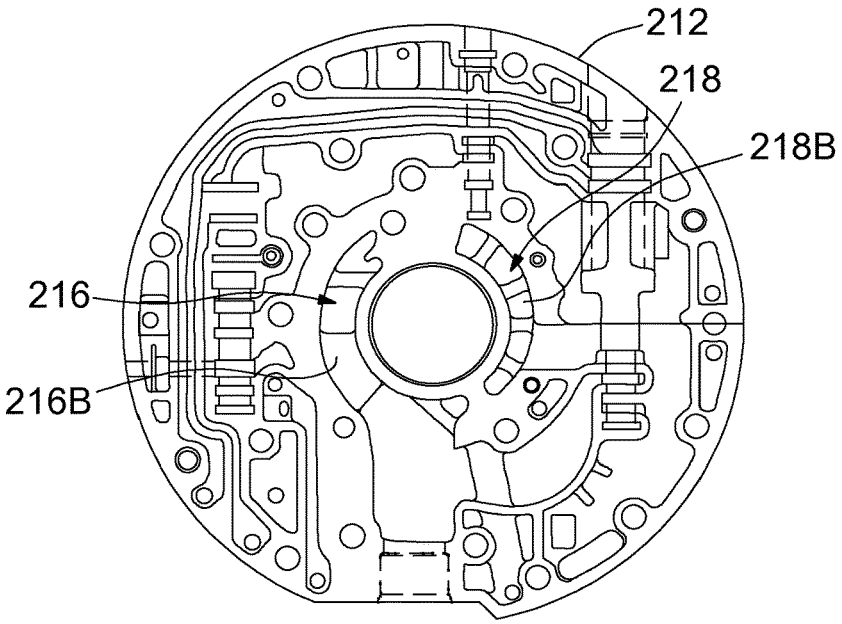
FIG. 7 is an elevation view of a portion of the remanufactured transmission pump illustrated in FIG. 5.
Figure 8:
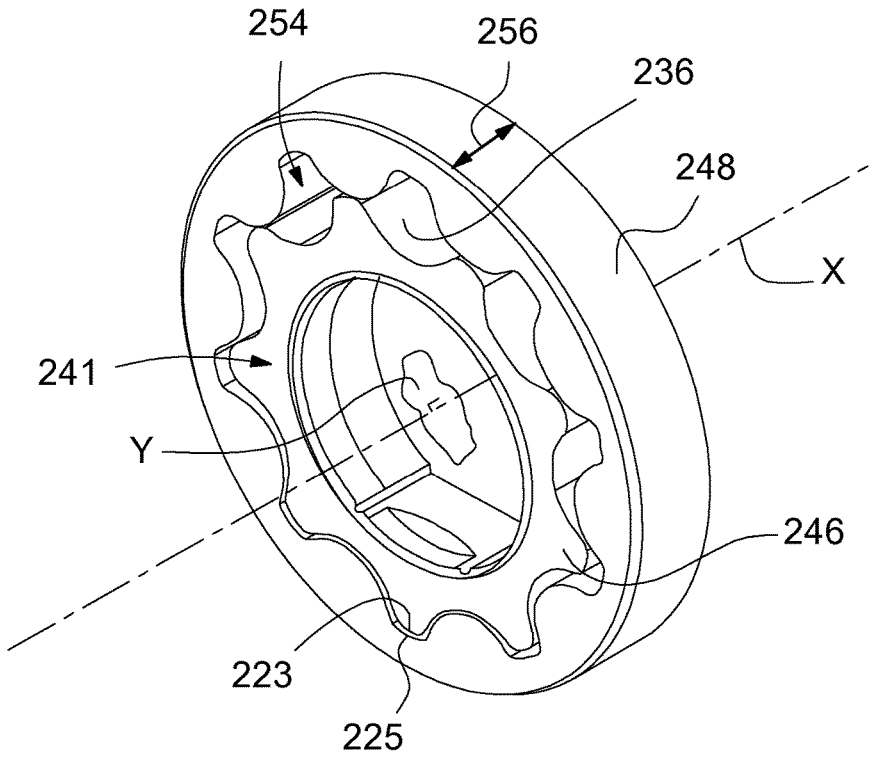
FIG. 8 is a perspective view of gears for the remanufactured transmission pump illustrated in FIG. 5.

FIG. 4 illustrates the inner and outer gears 122 and 124, respectively. The inner and outer gears 122 and 124, respectively, are such that the pump 108 operates as a gerotor pump. As is known to those skilled in the art, a gerotor pump has the inner gear 122 located off center from the outer gear 124 and there are a plurality of chambers, indicated generally at 134, between the inner and outer gears 122 and 124, respectively. As the inner and outer gears 122 and 124, respectively, rotate, each of the chambers 134 in turn increases and decreases in volume, which produces pumping action for the pump 108.

Each of the chambers 134 has a variable horizontal radial area 136 and a constant vertical or axial depth 138. The radial areas 136 are in a plane Y substantially perpendicular to the axis X and the axial depths 138 are substantially parallel to the axis X. As the inner and outer gears 122 and 124, respectively, rotate the radial areas 136 increase and decrease such that the volumes of the chambers 134 also increase and decrease. The radial areas 136 increase and decrease in a repeating pattern as the inner and outer gears 122 and 124, respectively, rotate. While the inner and outer gears 122 and 124, respectively, rotate, the axial depth 138 remains constant. The axial depth 138 is equal to a first gear thickness 140 (illustrated in FIG. 1) of the inner and outer gears 122 and 124, respectively, allowing for tolerances such as assembly or manufacturing tolerances. The inner and outer gears 122 and 124, respectively, having the same gear thickness 140. The gear thickness 140 is less than the first bore depth 128.

When a first point 123 on the inner gear 122 contacts a second point 125 on the outer gear 124, the inner and outer gears 122 and 124 have a specific horizontal geometry or arrangement, indicated generally at 141, in the plane Y and perpendicular to the axial depth 138. The horizontal geometry 141 is not limited to when the first and second points 123 and 125 contact but may be defined for any contact points between the inner and outer gears 122 and 124, respectively. The horizontal geometry 141 comprises the arrangement and relative spacing of the inner gear 122, outer gear 124, chambers 134, and radial areas 136 in the plane Y when the first point 123 contacts the second point 125. For example, the horizontal geometry 141 includes dimensions, perpendicular to the axis X, between the inner gear 122, outer gear 124, chambers 134, and radial areas 136.

FIGS. 5-8 illustrate a remanufactured transmission 200 having a remanufactured transmission pump assembly 208. Because the remanufactured transmission 200 is a variation on the transmission 100 of FIGS. 1-3, like reference numerals, increased by 100, designate corresponding parts in the drawings and detailed description thereof will be omitted. As used hereinafter, "remanufactured," "remanufacturing," and their variants mean an original automotive component that has entered service in an automobile, experienced a failure or significant wear, had the failure or wear addressed and resolved during a remanufacturing process, and is ready to be returned to service as a remanufactured component. For example, the remanufactured pump 208 is the pump 108 after a failure that has been addressed and resolved such that the remanufactured pump 208 is ready to reenter service. During the remanufacturing process, there is an opportunity for other improvements to be made to the part being remanufactured. For example, the pump 108 may be remanufactured to the pump 208 even when the pump 108 has not experienced a failure.

The remanufactured pump 208 has a new gear assembly 242 having new inner and outer gears 246 and 248, respectively. The new gear assembly 242 is in a remanufactured bore 244 having a second bore depth 250. The second bore depth 250 is greater than the first bore depth 128. For example, the second bore depth 250 may be 1.0 mm greater than the first bore depth 128. The new inner and outer gears 246 and 248, respectively, have a second gear thickness 252. The second gear thickness 252 is greater than the first gear thickness 140 by an amount corresponding to how much the second bore depth 250 is greater than the first bore depth 128. For example, if the second bore depth 250 is 1.0 mm greater than the first bore depth 128, then the second gear thickness 252 is also be 1.0 mm greater than the first gear thickness 140.

When a first point 223 contacts a second point 225, the new inner and outer gears 246 and 248, respectively, have a same horizontal geometry 241, as the inner and outer gears 146 and 148, respectively—i.e., radial areas 236 of the remanufactured chambers 254 are equal to the radial areas 136 of the chambers 154. However, a second axial depth 256 is greater than the first axial depth 138 by an amount by which the second gear thickness 252 is greater than the first gear thickness 140. For example, if the second gear thickness 252 is 1.0 mm greater than the first gear thickness 140, then the second axial depth 256 is also 1.0 mm greater than the first axial depth 138. When the first point 223 contacts the second point 225, the remanufactured chambers 254 are dimensionally the same as—i.e., unchanged from—the chambers 134 other than the greater second axial depth 256. Accordingly, the remanufactured pump 208 has increased flow rate compared to the pump 108 while flow characteristics at inlet and outlet ports 216 and 218, respectively, are unchanged from flow characteristics at the inlet and outlet ports 116 and 118, respectively.

Figure 9:
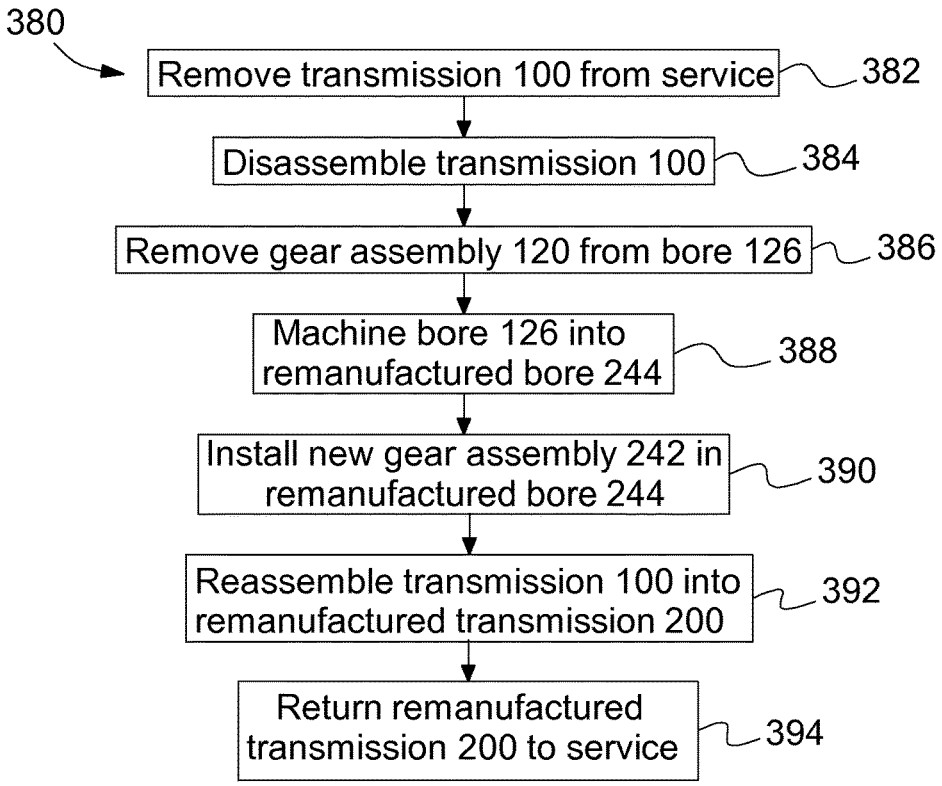
FIG. 9 is a flow chart of a method for remanufacturing the transmission pump illustrated in FIG. 1 into the remanufactured transmission pump illustrated in FIG. 5.

FIG. 9 illustrates a pump remanufacturing method, indicated generally at 380, for remanufacturing the pump 108 into the remanufactured pump 208. In a first step 382, the remanufacturing method 380 commences when the transmission 100 is removed from service. In a step 384, the transmission 100 is disassembled such that the pump 108 may be accessed. In a step 386, the gear assembly 120 is removed from the bore 126. In a step 388, the bore 126 is machined from the first bore depth 128 to the second bore depth 250 such that the bore 126 becomes the remanufactured bore 244. In a step 390, the new gear assembly 242 is installed in the remanufactured bore 244. In a step 392, following reassembly, remanufacturing is complete and the transmission 100 is now the remanufactured transmission 200. In a final step 394, the remanufactured transmission 200 is returned to service. As one skilled in the art will readily recognize, the pump remanufacturing method 380 may be incorporated into, or performed concurrently with, other remanufacturing methods for other components of the transmission 100.

Figure 10:
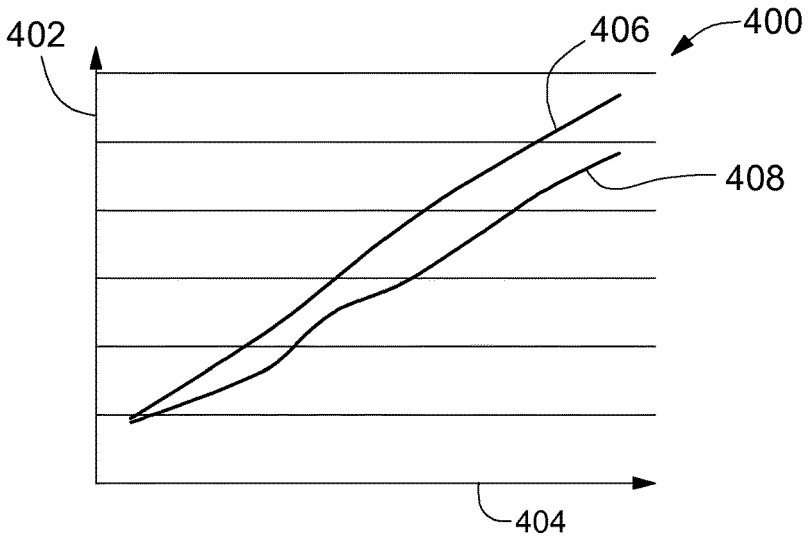
FIG. 10 is a graph of flow rates for the transmission pump of FIG. 1 and the remanufactured transmission pump of FIG. 5.

FIG. 10 illustrates a graph, indicated generally at 400, of flow rates of the transmission 100 using the pump 108 and the remanufactured transmission 200 using the remanufactured pump 208. Other than the remanufactured pump 208, the remanufactured transmission 200 may be unchanged from the transmission 100. Flow rate 402 is graphed as a function of engine speed 404. Flow rate of the remanufactured pump 208, indicated by a first plot 406, exceeds flow rate of the pump 108, indicated by a second plot 408, at the same engine speeds. This is accomplished by the increased second axial depth 256 of the remanufactured pump 208 compared to the pump 108. Because the radial areas 236 are equal to the radial areas 136, flow characteristics—e.g., pump pressure—are not changed at the inlet and outlet ports 216 and 218, respectively, from flow characteristics at the inlet and outlet ports 116 and 118, respectively.

While certain embodiments of the present invention have been described in detail, those familiar with the art to which this invention relates will recognize various alternative designs and embodiments for practicing the invention as defined by the following claims.

The invention claimed is:

1. A method of remanufacturing a pump for an automotive transmission comprising:

removing a first gear assembly, having first inner and outer gears, from the pump;

machining a bore of the pump from a first depth to a greater second depth;

installing a second gear assembly, having second inner and outer gears, in the machined bore, the second gear assembly having a same horizontal geometry and a greater axial depth than the first gear assembly.

2. The method of claim 1 wherein a first difference in the axial depth between first chambers in the first gear assembly and second chambers in the second gear assembly is equal to a second difference between the first and second bore depths.

3. The method of claim 1 wherein the second gear assembly has a greater gear thickness than the first gear assembly.

4. The method of claim 1 wherein a first difference in the axial depth between first chambers in the first gear assembly and second chambers in the second gear assembly is equal to a second difference in gear thickness between the first and second gear assemblies.

5. The method of claim 1 wherein the pump is a gerotor pump.

6. The method of claim 1 wherein first chambers are formed between the first inner and outer gears and the second chambers are formed between the second inner and outer gears.

7. The method of claim 1 further comprising:

disassembling the transmission to access the pump to remove the first gear assembly;

reassembling the transmission after the second gear assembly is installed.

8. The method of claim 1 further comprising:

removing the transmission from service before removing the first gear assembly;

returning the transmission to service after installing the second gear assembly.

9. The method of claim 1 wherein the horizontal geometry is perpendicular to the axial depth.

10. The method of claim 1 wherein the horizontal geometry is dimensions, perpendicular to the axial depth, between the first inner and outer gears of the first gear assembly and between the second inner and outer gears of the second gear assembly.

11. A method of remanufacturing a pump for an automotive transmission comprising:

disassembling a removed from service transmission to access the pump;

removing inner and outer gears from a bore of the pump;

machining the bore from a first depth to a greater second depth;

installing new inner and outer gears in the machined bore, wherein the new inner and outer gears have a same horizontal geometry, a greater axial depth than the removed inner and outer gears, the horizontal geometry is dimensions, perpendicular to the axial depth, between the removed inner and outer gears and between the new inner and outer gears; and reassembling the transmission after the new inner and outer gears are installed.

12. The method of claim 11 wherein the pump is a gerotor pump.

13. The method of claim 11 wherein a first difference in the axial depth between the removed inner and outer gears and the new inner and outer gears is equal to a second difference between the first and second bore depths.

14. A method of remanufacturing a pump for an automotive transmission comprising:

removing a first gear assembly from the pump;

machining a bore of the pump from a first depth to a greater second depth;

installing a second gear assembly in the machined bore, the second gear assembly having a same horizontal geometry and a greater axial depth than the first gear assembly, wherein the horizontal geometry is dimensions, perpendicular to the axial depth, between first inner and outer gears of the first gear assembly and between second inner and outer gears of the second gear assembly.

* * * * *